US009456642B2

(12) United States Patent
Lee

(10) Patent No.: US 9,456,642 B2
(45) Date of Patent: Oct. 4, 2016

(54) CONVERTIBLE SPORT WRAP GARMENT

(71) Applicant: UNCAGED, LLC, Omaha, NE (US)

(72) Inventor: Angela A. Lee, Omaha, NE (US)

(73) Assignee: Uncaged, LLC, Omaha, NE (US)

( * ) Notice: Subject to any disclaimer, the term of this patent is extended or adjusted under 35 U.S.C. 154(b) by 746 days.

(21) Appl. No.: 13/937,429

(22) Filed: Jul. 9, 2013

(65) Prior Publication Data

US 2014/0013481 A1 Jan. 16, 2014

Related U.S. Application Data

(60) Provisional application No. 61/670,364, filed on Jul. 11, 2012.

(51) Int. Cl.

| | |
|---|---|
| ***A41D 15/04*** | (2006.01) |
| ***A45F 4/02*** | (2006.01) |
| ***A41D 13/00*** | (2006.01) |
| ***A45F 4/00*** | (2006.01) |
| ***A45F 5/02*** | (2006.01) |

(Continued)

(52) U.S. Cl.

CPC ..... *A41D 15/04* (2013.01); *A41D 13/0017* (2013.01); *A45F 3/005* (2013.01); *A45F 3/14* (2013.01); *A45F 3/16* (2013.01); *A45F 4/00* (2013.01); *A45F 4/02* (2013.01); *A45F 5/02* (2013.01); *A41D 2400/46* (2013.01); *A45F 2003/144* (2013.01); *A45F 2003/146* (2013.01); *A45F 2003/148* (2013.01); *A45F 2003/166* (2013.01); *A45F 2004/006* (2013.01); *A45F 2004/023* (2013.01)

(58) Field of Classification Search

CPC ..... A41D 15/04; A41D 13/0017; A41D 2400/46; A45F 3/005; A45F 3/14; A45F 3/16; A45F 4/00; A45F 4/02; A45F 5/02; A45F 2003/144; A45F 2003/146; A45F 2003/148; A45F 2003/166; A45F 2004/006

See application file for complete search history.

(56) References Cited

U.S. PATENT DOCUMENTS

| | | | |
|---|---|---|---|
| 4,634,031 | A | 1/1987 | Frankhouse |
| 4,750,653 | A | 6/1988 | Prunty |

(Continued)

FOREIGN PATENT DOCUMENTS

| | | |
|---|---|---|
| JP | 2009-165598 | 7/2009 |
| KR | 20-0376077 | 3/2005 |

OTHER PUBLICATIONS

International Search Report and Written Opinion, dated Feb. 1, 2013, from co-owned International Application No. PCT/US2012/053015.

*Primary Examiner* — Shaun R Hurley
*Assistant Examiner* — Andrew W Sutton
(74) *Attorney, Agent, or Firm* — Greenberg Traurig, LLP

(57) ABSTRACT

A convertible sport wrap garment is disclosed that may convert to a purse/pack and vice versa. The garment may be formed of a composite fabric structure having an inner sheet and an outer sheet attached together to form a generally tubular shaped body. The garment may comprise an elastic fabric such that it fits snugly around the torso of the wearer. The garment may be worn around the waist and over one shoulder or both shoulders. A selectively closable pocket may be sandwiched between the inner and outer sheets, wherein the pocket may be accessible along one edge joining the inner and outer sheets, and wherein the garment may be folded into the pocket to convert the garment into a purse/pack.

18 Claims, 5 Drawing Sheets

(51) Int. Cl.

| | |
|---|---|
| ***A45F 3/14*** | (2006.01) |
| ***A45F 3/16*** | (2006.01) |
| ***A45F 3/00*** | (2006.01) |

(56) References Cited

U.S. PATENT DOCUMENTS

| | | | | |
|---|---|---|---|---|
| 6,112,960 | A | 9/2000 | Seering et al. | |
| D432,299 | S | 10/2000 | Vazquez | |
| D432,300 | S | 10/2000 | Vazquez | |
| D432,301 | S | 10/2000 | Vazquez | |
| 6,419,132 | B1 * | 7/2002 | Reed | A45C 15/00 109/49.5 |
| D468,904 | S | 1/2003 | Vazquez | |
| D469,251 | S | 1/2003 | Vazquez | |
| D469,604 | S | 2/2003 | Vazquez | |
| 6,595,396 | B2 | 7/2003 | Cummings et al. | |
| 6,634,041 | B2 | 10/2003 | Higashi et al. | |
| 6,644,527 | B1 | 11/2003 | Karenga | |
| 6,708,343 | B1 * | 3/2004 | Ceron | A41D 3/08 2/84 |
| 6,851,127 | B1 * | 2/2005 | Khan | A41D 13/00 2/84 |
| 6,886,726 | B1 | 5/2005 | O'Hare | |
| D505,787 | S | 6/2005 | Vaughn | |
| 7,870,982 | B2 | 1/2011 | Dong et al. | |
| 2002/0088048 | A1 * | 7/2002 | Turner | A41D 3/00 2/93 |
| 2002/0124294 | A1 * | 9/2002 | McKenzie | A41D 13/0002 2/69 |
| 2005/0039242 | A1 | 2/2005 | Edmondson | |
| 2005/0056669 | A1 * | 3/2005 | Lavelle | A41D 3/08 224/153 |
| 2006/0157525 | A1 | 7/2006 | Furlong et al. | |
| 2008/0067202 | A1 * | 3/2008 | Silva | A41D 13/01 224/148.2 |
| 2009/0229034 | A1 * | 9/2009 | Zmigrosky | A41D 1/08 2/79 |
| 2009/0320175 | A1 * | 12/2009 | Shih | A41D 15/00 2/69 |
| 2010/0237121 | A1 | 9/2010 | Stein | |
| 2012/0244768 | A1 * | 9/2012 | Oehlert | B63C 9/11 441/106 |
| 2013/0212772 | A1 * | 8/2013 | Apostoloff | A41D 3/00 2/93 |
| 2014/0373246 | A1 * | 12/2014 | Chapuis | A41D 1/00 2/69 |
| 2015/0203281 | A1 * | 7/2015 | Russo | A41D 3/08 206/458 |
| 2015/0250240 | A1 * | 9/2015 | Hunkele | A41D 3/04 2/86 |

* cited by examiner

CONVERTIBLE SPORT WRAP GARMENT

CROSS REFERENCE TO RELATED APPLICATIONS

This application claims the benefit of priority of U.S. Provisional Patent Application Ser. No. 61/670,364, filed Jul. 11, 2012, entitled Convertible Sport Wrap-Bandolier, the content of which is hereby incorporated by reference in its entirety.

BACKGROUND OF THE DISCLOSURE

U.S. Pat. Nos. 4,634,031 and D505,787 disclose typical over-the-shoulder pocket bandoliers. People, particularly women, often select their purses and/or scarves in a manner to complement their clothing. However, over the shoulder pocket bandoliers such as shown in these patents, are not constructed or designed as a garment to complement a wearer's outfit or make a complementary fashion statement. During exercise, women have a need to carry cash, cell phone, keys and other objects. Often a waist pack or backpack is used for this purpose. However, these packs tend to bounce around and are thus often uncomfortable during exercise. Therefore there is a need for a form fitting product that can carry normal purse items so as to circumvent such problems, and still look like part of the person's collective exercise outfit.

SUMMARY OF THE DISCLOSURE

A convertible garment in accordance with a first embodiment of the present disclosure provides an elastic fabric tubular body adapted to fit snugly around a person's torso. The garment can be worn as a one-shoulder wrap type garment. The garment includes a pocket accessable from an opening through which a person passes her head. The garment is preferably formed of an inner sheet and an outer sheet, with the pocket therebetween. In one embodiment, there is a single first upper opening for one of a person's arms and a second upper opening for the person's head and other arm. Optionally there may be another first upper opening spaced from the first upper opening for the person's other arm. When the pocket is turned inside out, the garment can be stuffed into this pocket to convert it into a clutch purse or waist pack. The pocket may be of sufficient size to carry the typical contents of a purse in addition to the wrap material.

One embodiment is a convertible garment that includes a fabric tubular body adapted to fit snugly around a person's torso, wherein the tubular body is formed of an inner tubular sheet and an outer tubular sheet fastened together to define the tubular body. The tubular body has at least one first upper opening, a second upper opening, and a bottom opening. The at least one first upper opening in the tubular body is adapted to allow one of the person's arms to pass therethrough. The second upper opening in the tubular body is adapted to allow at least the person's head to pass therethrough, and the bottom opening in the tubular body, opposite the at least one first upper opening and the second upper opening, is adapted to fit snugly around the person's waist. A pocket is formed in the tubular body between the inner and outer sheets. This pocket is preferably accessible along one edge of the second upper opening, such that the tubular body of the garment may be stuffed into the pocket to convert the garment into a purse or pack. The garment further may include a second first upper opening in the tubular body spaced from the second upper opening adapted to allow another of the person's arms to pass therethrough.

Another embodiment may further include two mating pairs of belt openings. One of each pair of belt openings may be located on the edges of the pocket and one of each pair of opening may be located on the tubular body adjacent the pocket. When the garment is converted to a purse/pack, the mating pairs of openings may align to allow a belt to pass through the openings.

In another embodiment, mating portions of a belt may be fastened to the side seams of the pocket, thus eliminating the need for the belt openings.

In still further embodiments, the garment may include a hydration bladder holder, a gun holster, or a cell phone holder.

Further features, advantages and characteristics of the embodiments of this disclosure will be apparent from reading the following detailed description when taken in conjunction with the drawing figures.

DETAILED DESCRIPTION

Figure 1:
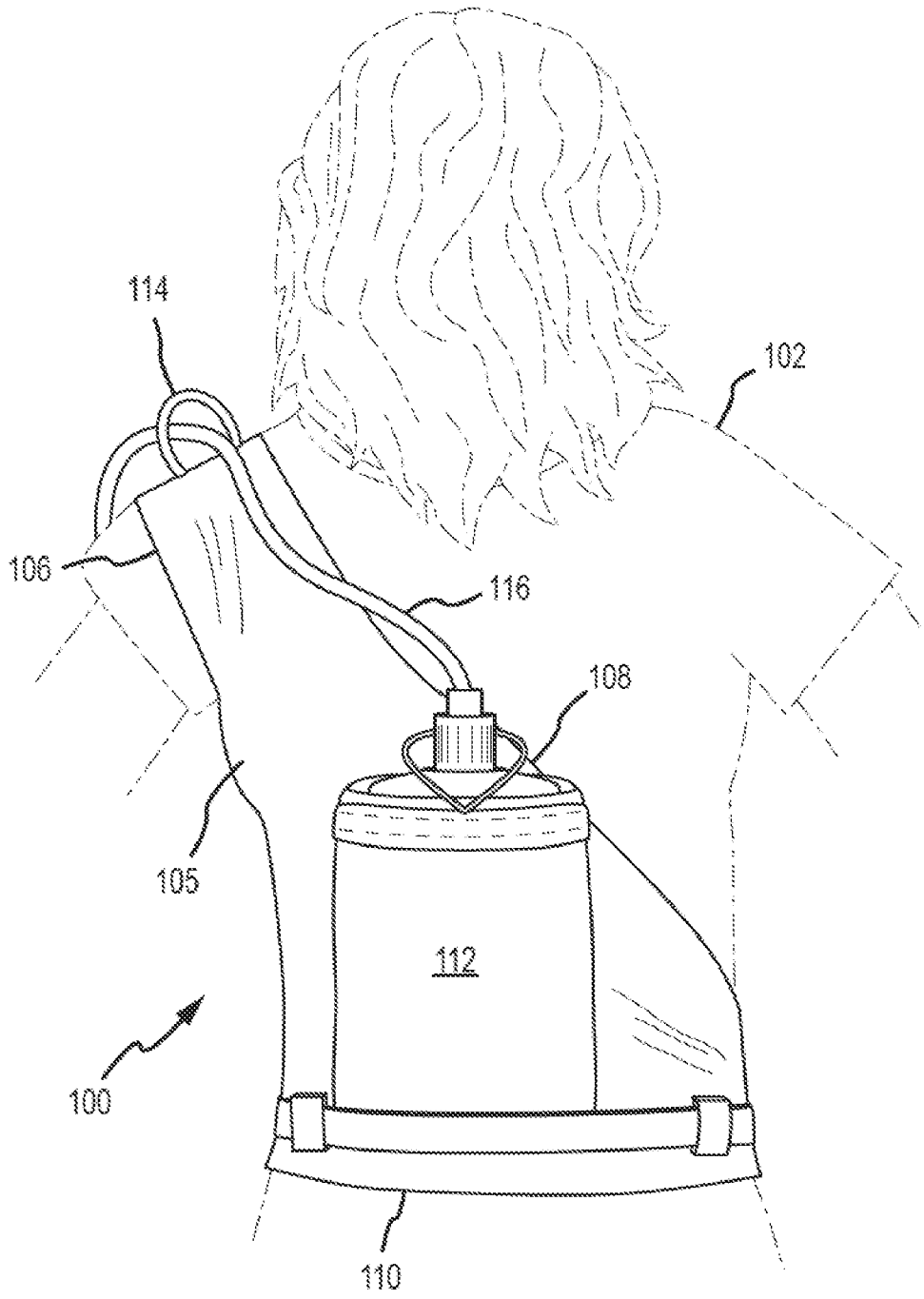
FIG. 1 is a perspective rear view of a person wearing a convertible sport wrap garment in accordance with the present disclosure.

A perspective view of a convertible sport wrap garment 100 worn by a person 102 in accordance with one embodiment is shown in FIG. 1. The garment 100 is a tubular body formed from an inner sheet 103 (shown in FIG. 2) and an outer sheet 105, preferably sewn together. The inner sheet 103 may be sewn or otherwise fastened along its outer edges to the outer sheet 105. The garment 100 may have a first upper opening 106 through which one of the person's arms passes. The garment 100 may also have a second upper opening 108 through which the person's head and opposite arm pass. The garment 100 may further have a bottom opening 110 sized to fit snugly around the person's waist.

The inner sheet 103 may comprise a stretchable or elastic fabric such that the garment 100 fits snugly around the person's torso during exercise. The outer sheet 105 may similarly comprise a stretchable or elastic fabric. A smooth elastic fabric such as spandex may be preferred so as to ride comfortably against the wearer's clothing or skin. The garment 100 may comprise stretchable or elastic mesh fabric to facilitate sweat evaporation during exercise.

As shown in FIG. 1, the garment 100 may include a hydration bladder holder 112. The garment 100 also may include a tube retainer or fastener 114 for holding a hydration bladder tube 116 adjacent the head of the person 102 wearing the garment 100. The tube retainer 114 may be attached to the outer sheet 105 adjacent to the first upper opening 106. When the garment 100 is worn over a left shoulder of the person 102, the hydration bladder holder 112 in this embodiment is on the outside surface of the garment 100. If the garment 100 is worn over a right shoulder of the person 102, it is simply turned inside out, and the hydration bladder holder 112 is between the garment outer sheet 105 and the person's back.

In one embodiment, the tube retainer 114 comprises a soft fabric so that when the garment 100 is worn inside out, the tube retainer 114 does not cause discomfort to the wearer. Further, a second soft fabric tube retainer (not pictured) may be attached to the inner sheet adjacent to the first upper opening 106 so that when the garment 100 is worn inside out, the second tube retainer is on the outside of the garment 100. In a another embodiment, the tube retainer 114 may comprise a first and a second slit (not pictured) in the tubular body adjacent to the first upper opening 106 such that the hydration bladder tube 116 may be passed into the first slit and out of the second slit.

Figure 3:
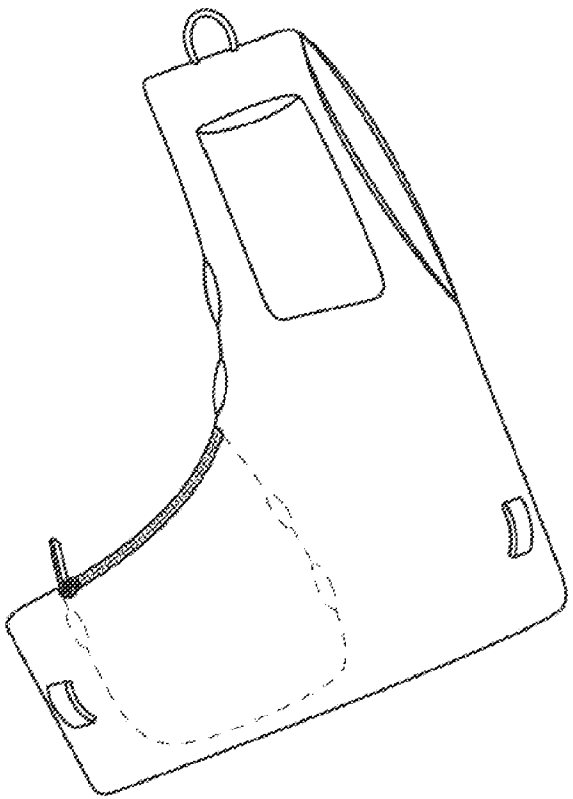
FIG. 3 is a separate right perspective view of the garment shown in FIG. 1.
Figure 2:
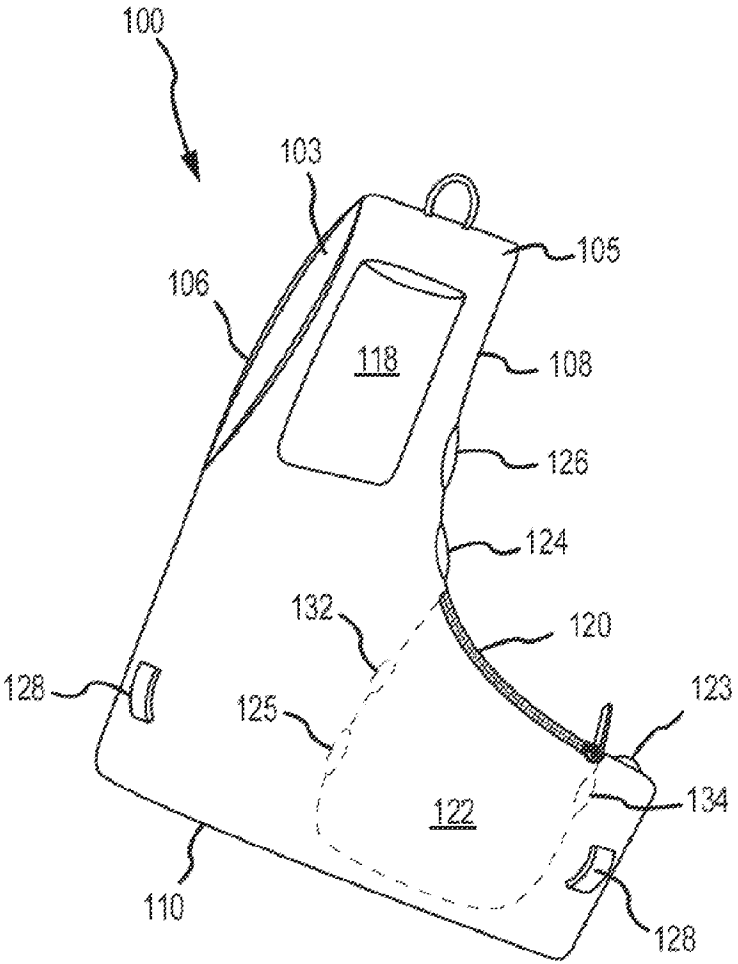
FIG. 2 is a separate left perspective view of the garment shown in FIG. 1.

Turning now to FIG. 2, a separate perspective view of one embodiment of the garment 100 is shown. FIG. 3 is a perspective view of the same garment 100 turned inside out, i.e., reversed, such that it can be worn over a person's right shoulder. Along a portion of one edge of the second upper opening 108 an internal fabric pocket 122 may be sewn or otherwise attached. The pocket 122 may be sandwiched between the inner and outer sheets. In the preferred embodiment, a zipper closure 120 is sewn along the top of the pocket 122 at the edge of the second upper opening 108 such that the pocket may be zipped shut. Adjacent the first upper opening 106 is preferably a cell phone holder 118 which may optionally include a zipper closure. In one embodiment, the garment 100 may include a slit (not pictured) adjacent the top of the cell phone pocket such that when the garment 100 is worn inside out, the cell phone holder 118 may be accessed through the slit.

In the embodiment of FIGS. 2, 3, along the edge of the second upper opening 108, adjacent top corners of the pocket 122, are belt openings 123 and 124. Also adjacent opening 124 is a bladder tube opening 126. Along the one side edge of the pocket 122 are belt opening 132 and bladder tube opening 125. Along the opposite side edge of the pocket is belt opening 134. Openings 123, 124, 125, 126, 132, and 134 will be explained in further detail below.

On opposite sides of the bottom opening 110 of the garment 100 are belt loops 128. Not shown in FIGS. 2 and 3 is the hydration bladder holder 112, which is omitted for clarity of explanation. The hydration bladder holder 112 may be sewn onto the garment 100 or alternatively may be removably fastened to its outer sheet via a hook and loop fabric patch or other suitable attachment method.

Figure 4:
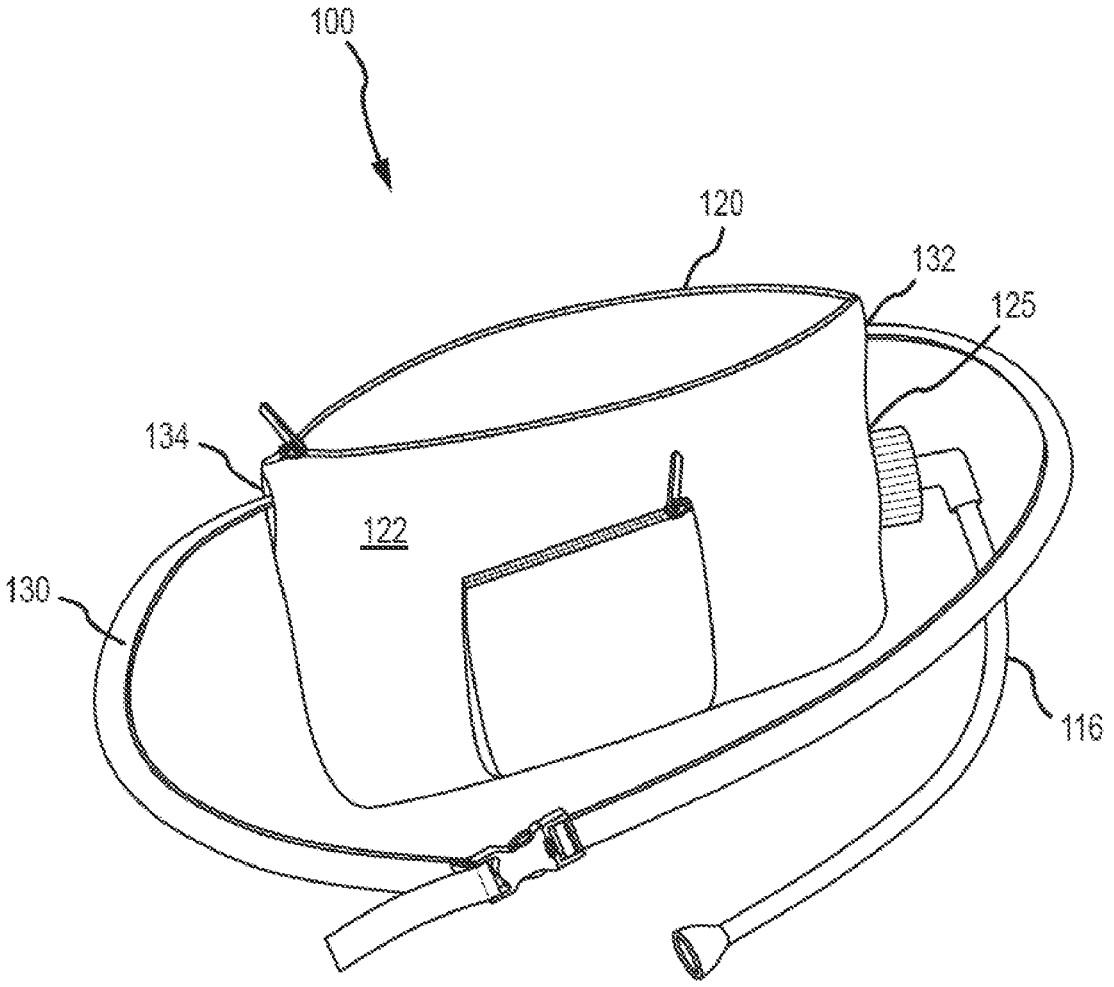
FIG. 4 is a perspective view of the garment shown in FIGS. 1-3 converted into a waist pack in accordance with an embodiment of the present disclosure.

FIG. 4 shows a perspective view of the garment 100 after being stuffed into the internal fabric pocket 122. This may be done by simply pulling the internal pocket 122 inside out and stuffing the garment 100 into the pocket. When the garment 100 is stuffed into the pocket 122, bladder tube openings 125 and 126 may align together. Hydration bladder tube 116 may then be passed through the aligned bladder tube openings 125 and 126, as shown in FIG. 4. Belt openings 134 and 123 may also align together as a pair, and belt openings 132 and 124 may align together as a pair. A belt 130 that may be conveniently stored in the pocket 122 may then be passed through aligned openings 124, 132 and through aligned openings 123, 134, so that the garment 100 may be worn as a pack. In an alternative embodiment, mating portions of the belt 130 may be fastened into and become a part of the pocket 122, thus eliminating a need for openings 123, 134 and 124, 132.

Figure 5:
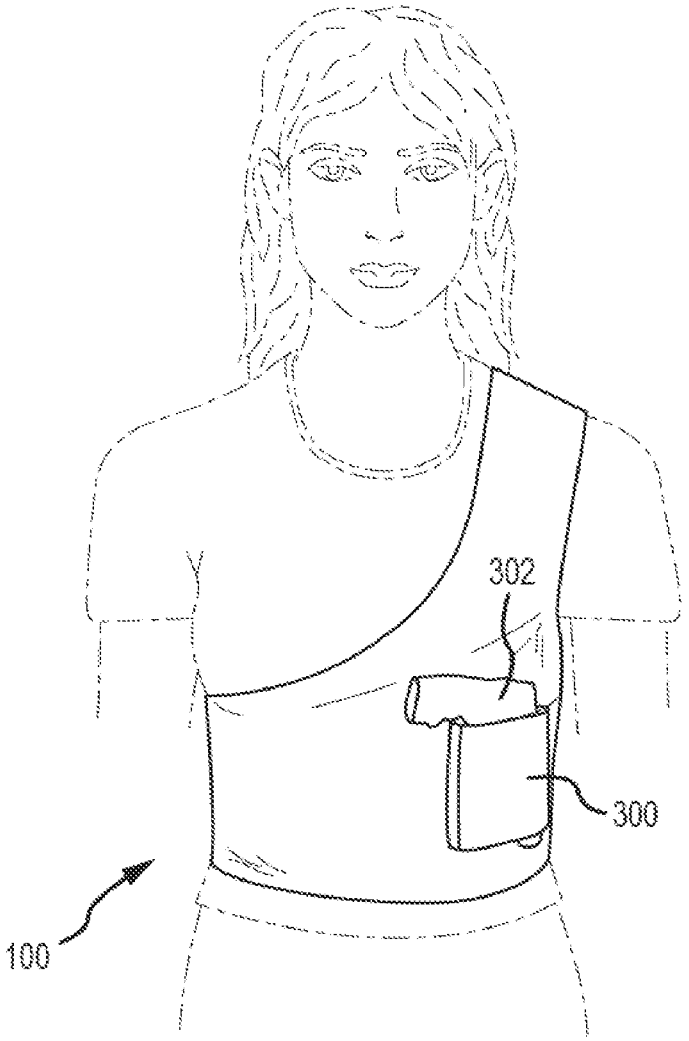
FIG. 5 is a perspective front view of a person wearing an alternative embodiment of the garment including a concealed carry holster for a pistol.
Figure 6:
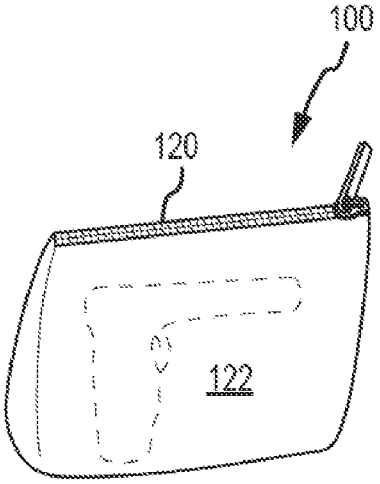
FIG. 6 is a perspective view of the garment shown in FIG. 5 converted into a purse/pack in accordance with an embodiment of the present disclosure.

FIG. 5 shows an alternative embodiment of the garment 100 in which a concealed carry holster 300 for a weapon, such as a pistol 302, is attached to or integrated into the tubular body of the garment 100. The garment 100 may be worn underneath clothing such that the pistol 302 is concealed. As shown in FIG. 6, when the garment 100 is converted into a pack by stuffing it into the pocket 122, the pistol 302 may be carried in the pack formed by the pocket 122.

Figure 7:
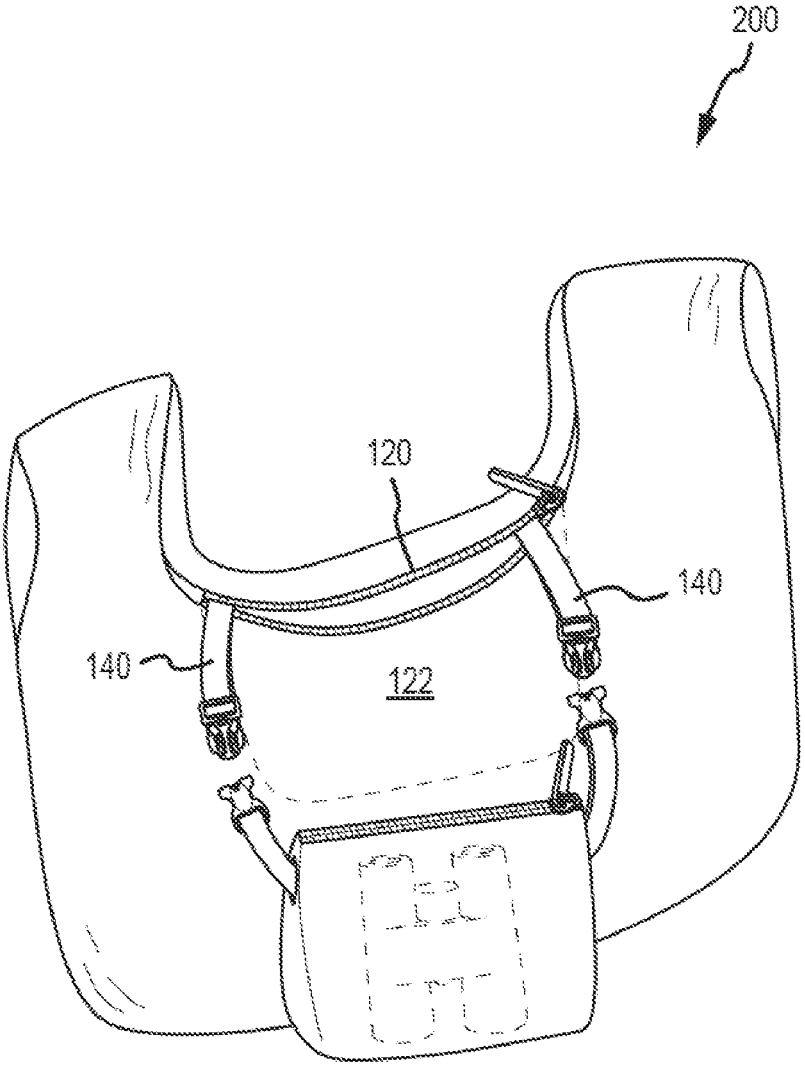
FIG. 7 is an alternative embodiment of the garment shown in FIGS. 1-3 with straps and clips to attach an accessory such as a pair of binoculars.

FIG. 7 shows a double shoulder alternative embodiment 200 of the garment in which the internal pocket 122 holds a pair of strap ends 140 with quick connect clips 142 for attaching an accessory such as binoculars. In this embodiment the garment 200 has two opposite upper arm openings, so that it is worn much like a shirt, and an internal pocket 122 in the front. Embodiment 200 may be converted into a pack by pulling the pocket 122 inside out and stuffing the garment material into the pocket 122.

There are many alternatives and modifications that will be apparent to those skilled in the art. For example, the garment 100 may be configured with additional pockets and holders. The garment 100 may also be configured with a shoulder strap extending from the tubular body such that when the garment is worn over the right shoulder, the shoulder strap may be worn over the left shoulder, and vice versa. The garment 100 may also include a short sleeve portion for the upper arm of the person such that it will not slip down off the person's shoulder when worn during exercise. All such changes, alternatives and equivalents in accordance with the features and benefits described herein, are within the scope of the present disclosure. Such changes and alternatives may be introduced without departing from the spirit and broad scope of my invention as defined by the claims below and their equivalents.

What is claimed is:

1. A convertible garment comprising:

a fabric tubular body adapted to fit snugly around a person's torso, wherein the tubular body comprises:

at least one first upper opening in the tubular body adapted to allow one of the person's arms to pass therethrough;

a second upper opening in the tubular body adapted to allow the person's head to pass therethrough;

a bottom opening in the tubular body, opposite the first and second upper openings, adapted to fit snugly around the person's waist;

a pocket in the tubular body, accessible along one edge of the second upper opening;

a first belt opening in the pocket along one side edge of the pocket;

a second belt opening in the tubular body adjacent the pocket and the one side edge;

a third belt opening in the pocket along an opposite side edge of the pocket; and a fourth belt opening in the tubular body adjacent the pocket and the opposite side edge;

wherein the garment may be stuffed into the pocket to convert the garment into a purse or pack and wherein the first and second belt openings are aligned together and the third and fourth belt openings are aligned together when the garment is stuffed into the pocket to permit a belt to pass through the openings.

2. The garment of claim 1, further comprising a second first upper opening spaced from the second upper opening adapted to allow another of the person's arms to pass therethrough.

3. The garment of claim 1, further comprising a pair of mating belt portions attached to the pocket, wherein the belt portions facilitate the wearing of the garment as a pack when the garment is stuffed within the pocket.

4. The garment of claim 1, further comprising a hydration bladder holder attached to a portion of the tubular body for receiving a hydration bladder therein.

5. The garment of claim 4, further comprising a tube retainer attached to the tubular body adjacent to the first upper opening for retaining a hydration bladder tube.

6. The garment of claim 4, wherein the hydration bladder holder is removable.

7. The garment of claim 4, further comprising a first bladder tube opening in the pocket and a second bladder tube opening in the tubular body, wherein the first and second bladder tube openings are aligned together when the garment is stuffed into the pocket to permit the bladder tube to pass through the openings.

8. The garment of claim 1, further comprising a concealed carry holster adapted to hold a weapon.

9. The garment of claim 1, wherein the tubular body further comprises an inner tubular sheet and an outer tubular sheet fastened together to define the first and second upper opening and the bottom opening.

10. A convertible garment comprising:

a fabric tubular body adapted to fit snugly around a person's torso, wherein the tubular body comprises:

an inner tubular sheet and an outer tubular sheet fastened together to define the tubular body and at least one first upper opening, a second upper opening, and a bottom opening, the at least one first upper opening in the tubular body adapted to allow one of the person's arms to pass therethrough, the second upper opening in the tubular body adapted to allow at least the person's head to pass therethrough, and the bottom opening in the tubular body, opposite the at least one first upper opening and the second upper opening, adapted to fit snugly around the person's waist; and a pocket in the tubular body between the inner and outer sheets, accessible along one edge of the second upper opening;

a first belt opening in the pocket along one side edge of the pocket;

a second belt opening in the tubular body adjacent the pocket and the one side edge;

a third belt opening in the pocket along an opposite side edge of the pocket; and a fourth belt opening in the tubular body adjacent the pocket and the opposite side edge, wherein the first and second belt openings are aligned together and the third and fourth belt openings are aligned together when the garment is stuffed into the pocket to permit a belt to pass through the openings, converting the garment into a purse or pack.

11. The garment of claim 10 further comprising a second first upper opening in the tubular body spaced from the second upper opening adapted to allow another of the person's arms to pass therethrough.

12. The garment of claim 10, further comprising a pair of mating belt portions attached to the pocket, wherein the belt portions facilitate the wearing of the garment as a pack when the garment is stuffed within the pocket.

13. The garment of claim 10, wherein the purse or pack is a waist pack.

14. The garment of claim 10, further comprising a hydration bladder holder attached to a portion of the tubular body for receiving a hydration bladder therein.

15. The garment of claim 14, further comprising a tube retainer attached to the tubular body adjacent to the first upper opening for retaining a hydration bladder tube.

16. The garment of claim 14, wherein the hydration bladder holder is removable.

17. The garment of claim 14, further comprising a first bladder tube opening in the pocket and a second bladder tube opening in the tubular body, wherein the first and second bladder tube openings are aligned together when the garment is stuffed into the pocket to permit the bladder tube to pass through the openings.

18. The garment of claim 10, further comprising a concealed carry holster adapted to hold a weapon.

* * * * *